United States Patent [19]

Smith

[11] Patent Number: 5,062,928

[45] Date of Patent: Nov. 5, 1991

[54] PROCESS FOR PRODUCING COLOR CHANGE DEVICES INCORPORATING LATENT INDICIA AND THE RESULTING DEVICES

[75] Inventor: Gary J. Smith, Glenburnie, Canada

[73] Assignee: Alcan International Limited, Quebec, Canada

[21] Appl. No.: 510,175

[22] Filed: Apr. 17, 1990

[51] Int. Cl.[5] ..... C25D 11/34

[52] U.S. Cl. ..... 204/15; 204/38.3; 204/56.1

[58] Field of Search ..... 204/15, 38.3, 58.1, 204/56.1; 427/7; 156/234

[56] References Cited

U.S. PATENT DOCUMENTS

| | | | |
|---|---|---|---|
| 841,321 | 1/1927 | Howard | 428/915 |
| 2,360,325 | 12/1944 | Higbee | 428/915 |
| 4,082,573 | 4/1978 | Williams | 428/915 |
| 4,082,873 | 4/1978 | Williams | 428/915 X |
| 4,098,940 | 7/1978 | Groh et al. | 428/915 X |
| 4,322,466 | 3/1982 | Tomlinsen | 428/915 |
| 4,424,911 | 1/1984 | Resnick | 428/916 |
| 4,480,760 | 11/1984 | Schonberger | 215/230 |
| 4,489,841 | 12/1984 | Thompson | 215/230 |
| 4,502,605 | 3/1985 | Wleszczyan | 215/230 |
| 4,511,052 | 4/1985 | Howard | 215/230 |
| 4,516,679 | 5/1985 | Simpson et al. | 428/916 |
| 4,519,515 | 5/1985 | Schonberger | 215/230 |
| 4,557,505 | 12/1985 | Schaefer et al. | 428/916 |
| 4,591,062 | 5/1986 | Sandhaus | 215/230 |
| 4,662,653 | 5/1987 | Greenaway | 428/915 X |
| 4,705,300 | 11/1987 | Benning et al. | 283/91 |
| 4,721,217 | 11/1988 | Phillips et al. | 283/91 |
| 4,837,061 | 6/1989 | Smits et al. | 428/40 |

FOREIGN PATENT DOCUMENTS 0227423 7/1987 European Pat. Off. .

OTHER PUBLICATIONS

L. Young, 1957, Transactions Faraday Soc. #58, p. 841.

W. E. Hillig et al., in D. A. Virmilysa, 1957, J. Electric Chemical Soc. #104, p. 485.

R. E. Powel et al., 1964, J. Applied Physics #35, p. 435.

Al Aladjem et al., 1060 J. Vacuum Science and Technology #6 p. 635.

The Optical Prop. of Thin Oxide Films on Ti, Charlesby et al., Proc. Royal Soc. 227 (1955) pp. 434–443.

Anodizing Reactive Metals, Seely, Metal Finishing 8/1988.

R. E. Powel et al., 1972, J. Electrochemical Soc. #119, p. 25.

(List continued on next page.)

*Primary Examiner*—John F. Niebling
*Assistant Examiner*—William T. Leader
*Attorney, Agent, or Firm*—Cooper & Dunham

[57] ABSTRACT

A process for producing color change devices incorporating latent indicia and color change devices incorporating latent indicia produced by the process. The process involves anodizing a color generating metal, having limited surface areas thereof covered by a mask, in the presence of a fluoride as an adhesion-reducing agent in order to produce a color-generating laminate incorporating an anodic film having detachable and non-detachable areas. The improvement of the invention involves forming the mask from a masking material which permits anodization of areas of the surface covered by the mask while preventing the adhesion-reducing agent from exerting a substantial adhesion-reducing effect in the areas of the surface covered by the mask. The anodic film having the detachable and non-detachable areas can then be formed by means of a single anodization step carried out in the presence of the adhesion-reducing agent. It is therefore unnecessary to employ two partial anodization steps as in the past, which simplifies the fabrication procedure and makes the procedure less expensive.

16 Claims, 1 Drawing Sheet

OTHER PUBLICATIONS

B. Maurel et al., 1972, J. Electrochemical Soc. #119, p. 1715.

The Optical Properties of Thin Oxide Films on Tantalum-Charlesby et al.,-Proc. Royal Society A 227 (1955) 434,443.

Anodizing the Reactive Metals-Seeley-Metal Finishing Aug. 1986.

Metallurgy of the Rarer Metals-6 Tantalum, Niobium G. L. Miller-Butterworth Scientific Publications London 1959.

The Coloration of Refractory Metals-James B. Ward-American Metal Smith.

L. Young, 1957, Transactions Faraday Society 58, 841.

W. E. Hillig Cited in D. A. Vermilyea, 1957, J. Electrochemical Society 104, 485.

R. E. Pawel and T. S. Lundy, 1964, J. Applied Pysics 35, 435.

A. Aladjem and D. G. Brandon, 1965, J. Vacuum Science and Technology 6, 635.

R. E. Pawel, J. P. Pemsler and C. A. Evans, 1972, J. Electrochemical Society 119, 25.

B. Maurel, D. Dieumegard and G. Amsel, 1972, J. Electrochemical Society 119, 1715.

PROCESS FOR PRODUCING COLOR CHANGE DEVICES INCORPORATING LATENT INDICIA AND THE RESULTING DEVICES

BACKGROUND OF THE INVENTION

I. Field of the Invention

This invention relates to devices which undergo a change of colour when physically disturbed in some way (referred to hereinafter as colour change devices) and to processes for producing such devices. More particularly, the invention relates to a process for producing colour change devices which incorporate latent indicia.

II. Description of the Prior Art

In our prior U.S. Pat. No. 4,837,061 to Smits et. al. issued on June 6, 1989 (the disclosure of which is incorporated herein by reference), a process for producing colour change devices, particularly those used as tamper evident structures, is disclosed. The process involves anodizing a colour generating metal such as a valve metal (e.g. Ta, Nb, Zr, Hf and Ti), a refractory metal (e.g. W, V and Mo), a grey transition metal (e.g. Ni, Fe and Cr), a semimetal (e.g. Bi) or a semiconductor (e.g. Si), in order to form an anodic film of metal oxide having a thickness in the order of the wavelength of light on the surface of the colour generating metal. The resulting laminates exhibit a strong interference colour when illuminated with white light because of light interference effects caused by reflections of the light from the closely spaced metal and oxide surfaces and because of light absorption which takes place at the metal/oxide interface. The resulting structures can be used as colour change devices if the anodization is carried out in the presence of an adhesion reducing agent (e.g. a flouride) which lowers the normally tenacious adhesion of the oxide film to the metal substrate. This allows the oxide film to be detached from the substrate with consequent destruction or modification of the exhibited colour. Reattachment of the oxide layer does not result in regeneration of the original colour, so the essentially irreversible colour change is an effective indicator of tampering.

The detachment of the anodic film from the metal substrate can be assisted by adhering a transparent or translucent sheet to the anodic film and using this sheet to reinforce the delicate film so that the film can be detached from the metal substrate in amounts large enough to be readily visible.

The above-mentioned patent also discloses a procedure for incorporating "latent indicia", e.g. initially invisible messages, patterns or designs, into the resulting colour change devices. This is achieved by masking off predetermined areas of the colour generating metal, carrying out partial anodization in the presence of the adhesion reducing agent to reduce the adhesion of the oxide film to the metal substrate in the unmasked areas, removing the mask and then continuing the anodization of the whole device in an electrolyte containing no adhesion reducing agent. The oxide film which is formed on the previously masked areas of the metal during the final anodization step adheres tenaciously to the metal but the film formed on the unmasked areas is detachable. As a consequence of this, when attempts are made to peel the entire anodic film from the metal substrate, the film detaches only in those areas which were originally unmasked and the generated colour is destroyed or changed in those areas but remains visible in the originally masked ares of the device. By making the masked areas have suitable shapes, the areas of the device exhibiting the original colour (or, conversely, those which lose the original colour) can take on the form of any desired message, pattern or design visible against a contrasting background following separation of the detachable parts of the anodic film.

There are variations of this technique, as disclosed in the above patent, but all involve two separate partial anodization steps, one with an adhesion reducing agent in the electrolyte and one without, and this is troublesome, especially when attempts are made to operate the procedure on a commercial scale.

It would therefore be desirable to develop a procedure whereby latent indicia could be incorporated into colour change devices of this kind by means of a simpler process.

OBJECTS OF THE INVENTION

An object of the present invention is to provide a process in which latent indicia can be incorporated into colour change devices of the type described above employing a single anodization step.

Another object of the invention is to provide a process of this kind which is suited to continuous production techniques.

SUMMARY OF THE INVENTION

According to one aspect of the present invention there is provided, in process for producing colour change devices incorporating latent indicia by anodizing a colour-generating metal, having limited surface areas thereof covered by a mask, in the presence of an adhesion-reducing agent in order to produce a colour-generating laminate incorporating an anodic film having detachable and non-detachable areas, the improvement which comprises forming said mask from a masking material which permits anodization of areas of said surface covered by said mask while preventing said adhesion-reducing agent from exerting a substantial adhesion-reducing effect in said areas of said surface covered by said mask, and forming an anodic film having detachable and non-detachable areas by means of a single anodization step carried out in the presence of said adhesion-reducing agent.

The invention also relates to a colour change device incorporating latent indicia produced by a process as defined above.

By the term "optically thin" as used herein to describe an anodic film, we means that the film has a thickness in the order of the wavelength of light so that the required interference effects can be produced for colour generation.

DETAILED DESCRIPTION OF THE PREFERRED EMBODIMENTS

Figure 1:
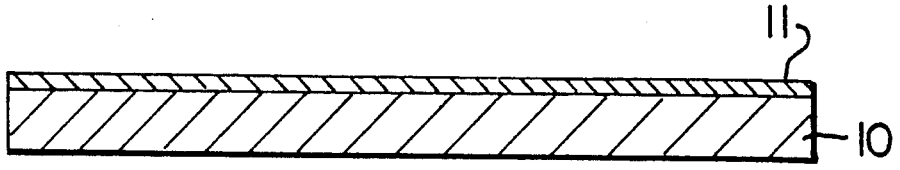
FIG. 1 is a cross-section of a metal substrate on which the process of the invention can be carried out.

The present invention is based, at least in part, on the unexpected finding that certain materials, for example certain inks and uncured resins, have the ability, when deposited in thin layers on anodizable metal substrates, of permitting anodization of the metal immediately beneath them to take place, but also of blocking, counteracting or neutralizing the effect of adhesion reducing agents contained in the electrolytes used for the anodizations. Consequently, if these materials are used to mask off areas of a metal where detachment of the anodic film is to be prevented, anodization of the metal in an electrolyte containing an adhesion reducing agent results in the growth of an anodic film of uniform thickness having detachable areas and non-detachable areas. Thus by properly choosing the masking material, the incorporation of latent indicia into colour change devices can be achieved by a process requiring just one anodization step.

The fact that certain materials, when used to form masks, have the ability to permit anodization of the surface they mask to take place while somehow blocking or counteracting the effect of the adhesion reducing agent is surprising. If anodization can take place beneath the material, the layer of the material must presumably be permeable to ions since anodization involves ion transportation. On the other hand, while adhesion reducing agents, such as fluorides, are generally ionic, it appears that the masking materials prevent these ions from reaching the metal surface and tusk reducing the adhesion of the anodic film at this surface. These two effects consequently seem mutually exclusive, but nevertheless are observed to take place.

It is theorized that the blocking action of the masking material only occurs at the initial stage of anodizing. Once a thin layer of oxide has been formed, the masking material lifts off the surface of the metal and further anodizing does not alter the release pattern already imparted, i.e. the anodic film itself may serve to block or neutralize the effect of the adhesion-reducing agent.

The materials which have ben found to be effective in the present in the invention are, in general, printing inks and conventional uncured resist materials, but it is likely that other materials may have similar effects and that these materials can be identified by simple experimentation. It should therefore be understood that the present invention is not limited to the preferred materials mentioned herein.

It has been found, however, that when conventional resist materials are used, they should normally be in the uncured form because cured resists prevent anodization from taking place beneath the resist. This gives rise to a further advantage because it eliminates the need for an extra step of curing the resist and the difficulty of removing cured resists from the metal surface after anodization has taken place.

The inks and uncured resists employed in the present invention can usually be removed, after the anodization step, simply by washing the anodized product with water, although caustic aqueous solutions (e.g. 4% NaOH by weight) may be more effective, especially for the uncured resists.

At present, it has ben found that only non-aqueous solvent-based materials wok in the process of the invention because water-based materials, e.g. uncured water-based inks, tend to disintegrate or partially dissolve in the aqueous anodizing bath before anodization is complete.

Inks and resists which have been fond to be effective are those containing polystyrene, polyamide, nitrocellulose, epoxy resins, alkyd resins, epoxy acrylates, etc. as well as non-aqueous solvents such as methanol and methyl ethyl ketone, etc. It therefore appears that the inks or resists should desirably contain a long chain preferably cross-linkable organic polymer and a non-aqueous solvent, but there is no reason to exclude other materials which may be found by suitable experimentation.

The polymer solutions, inks and resists used in the present invention should be used at a suitable dilution to permit easy application while achieving the desired blocking or neutralization of the adhesion-reducing agent and permitting anodization to take pace beneath them. The appropriate concentrations vary according to the material employed, but can easily be found by simple trail and experimentation. Generally concentrations suitable for normal printing or silk-screening are suitable, sometimes with minor variations.

Specific inks, resists and other materials which have been found useful to date include the following products identified by their commercial trade names:

MACUMAGE 19408——an ultra violet curable screen printing etch resists sold by MacDermid Co. containing an epoxy acrylate polymer;

R-569 ALKA-STRIP*——a screen printing etch resists sold by Advance Supply Co. containing an alkyd resin and glycol ether solvent;

A48889*——a modified nitrocellulose-based flexographic ink sold by BASF Co.;

A48893*——a polyamide-based flexographic ink sold by BASF Co.;

CR4281*——a polyamide-based flexographic ink sold by BASF Co.;

VASELINE——a petroleum jelly;

EB-157——an epoxy based screen printing ink sold by Ink Dezyne Co.;

16-8200Q——an ink jet printing ink sold by Video Jet Co. which is a complex mixture of ingredients, the major one being polystyrene, and including methanol and methyl ethyl ketone solvent systems;

16-8700Q——an ink jet printing ink sold by Video Jet Co. similar in composition to the product immediately above;

16-7800Q——an ink jet printing ink sold by Video Jet Co. againt similar to the 16-8200Q product mentioned above.

*These materials are preferably diluted (e.g. 30%) with a suitable solvent (e.g. butyl Cellosolve) to slow down their drying times. The other materials can be used without dilution.

The masking materials of the present invention can be applied to the colour generating metals by simple conventional techniques, e.g. silk-screening, stamping, spraying through a mask, painting, brushing, screen painting, flexographic painting, rubbing on, etc.

The thickness of the layer of the material used to mask the anodizable metal does not appear to play a very critical role in the observed effects, and thicknesses which can easily be formed by the conventional techniques mentioned above can generally be employed in the present invention. The process has been found to work with ink resist thicknesses of $<1\mu m$ to $100\mu m$ covering the practical working range, but thicknesses outside this range may also work. It may be the case that optimum thicknesses exist, but if so, the optimum thickness is likely to be different for each masking material.

The anodization conditions, electrolytes, metals and end uses of the resulting devices can be essentially the same as those described in the patent referred to above.

The concentration levels of head adhesion-reducing agent may be the same as those employed in the patent mentioned above or lower e.g. as low as 0.003% by volume in the case of fluoride. While there is no precise upper limit for the amount of the adhesion-reducing agent employed in the electrolyte, generally the concentration should be no higher than that required to produce a suitable effect. Very high levels may exceed the ability of the masking material to block, counteract or neutralize the effect of the adhesion-reducing agent during the single anodization step. Concentrations of fluoride in the range of 30 to 90 ppm for tantalum and 150 to 400 ppm for niobium, are usually suitable.

In most cases, the adhesion-reducing agent is dissolved in the electrolyte used for the anodization step, but it could also be coated on the surface of the masked colour-generating metal prior tot he anodization step or otherwise made present during the anodization. In any event, the adhesion-reducing agent becomes partially or completely dissolved or dispersed in the electrolyte at the initial stage of the anodization.

Specific embodiments of the present invention are described in more detail below with reference to the accompanying drawings.

FIG. 1 is a cross section of a substrate suitable for the anodization procedure the substrate consists of an aluminum layer 10 having a very thin sputtered layer 11 of tantalum metal. This arrangement is more preferable than the use of a thick layer of Ta because of the high cost of Ta metal.

Figure 2:
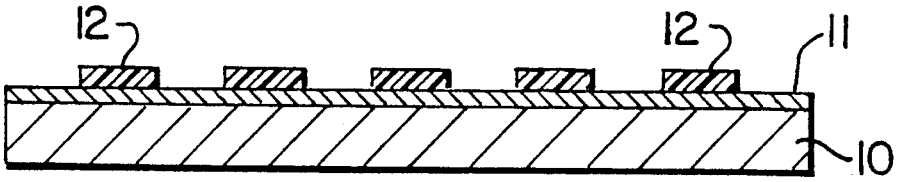
FIGS. 2 to 4 are similar cross-sections showing steps in the process.

FIG. 2 is a cross section similar to FIG. 1 showing the application of a masking material 12 to certain areas of the Ta layer 11, this material being of the type referred to above.

Figure 3:
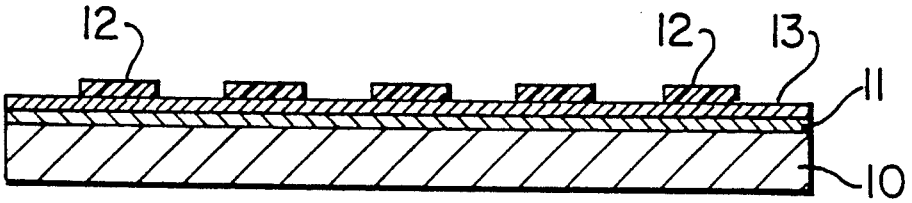

FIG. 3 shows the structure after anodization has been carried out in an electrolyte containing an adhesion reducing agent, e.g. 0.25 M citric acid solution containing a small amount of HF. The anodization has resulted in the formation of an anodic metal oxide film 13 on the surface of the Ta layer 11. The thickness of the anodic film 13 is uniform throughout since the presence of the masking material 12 does not affect there of anodization beneath the material compared with that taking place int he exposed areas of the Ta film. The anodization can be carried out to completion, if desired, because Ta and other colour generating metals do not undergo further anodization once the anoidic film has reached a certain maximum thickness. Once this thickness has been reached, the anodic film itself acts as a barrier to further anodization so that additional oxide is not formed. The maximum thickness of the anoidic film depends on the anodization voltage but is in the order of the wavelength of light for most practical voltages.

Figure 4:
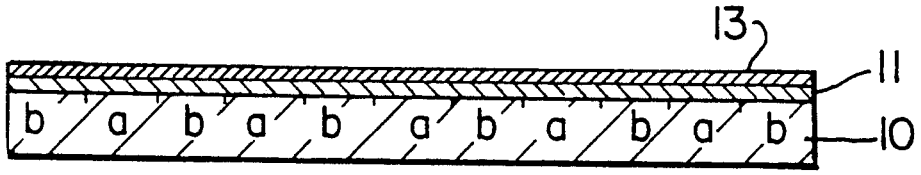

FIG. 4 shows the structure after the removal of the material 12, e.g. by washing. The areas of the device which were covered with the masking material 12, which areas are labelled a in the Figure, are visually indistinguishable from the uncovered areas labelled b. The colour generated by the structure is uniform in terms of the and brightness over the entire anodized surface area and any pattern or message resulting from the masking treatment is unobservable. Despite this, there is a difference between the areas a and b, namely that the HF in the electrolyte has weakened the adhesion between the Ta and oxide layers 11 and 13, respectively, in the areas b but not in the areas a.

Figure 5:
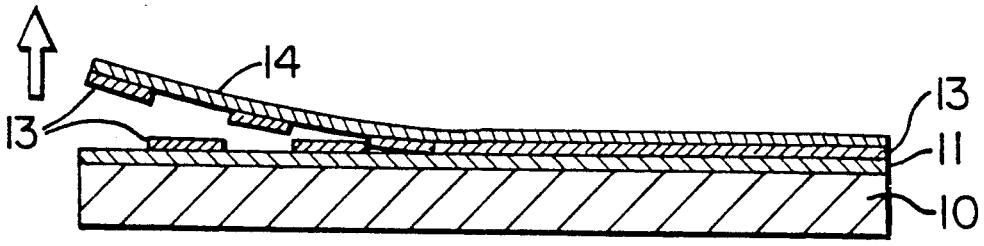
FIG. 5 is a further cross-section showing the effects of peeling a structure produced according to the present invention.

FIG. 5 shows the structure of FIG. 4 after the application of a transparent plastic sheet 14 (e.g. made of polypropylene preferably heat sealed to the anoidic film 13) and partial peeling of the plastic sheet from the substrate. As the peeling takes place, the anodic film 13 is detached from the underlying structure in the areas b, but remains attached to the underlying structure in the areas a because of the tenacious adhesion of the anoidic film to the Ta in these areas. The device remaining after the peeling step appears coloured in the area but has a metallic appearance in the areas b. Hence the latent message or pattern is made visible.

If the aluminum layer 10 is in the form of a thin flexible foil, and if the transparent layer 14 is quite thick, the underlying structure can be peeled away from the layer 14 rather than vice versa, with the same effect.

The invention is illustrated further by the following non-limiting Examples.

EXAMPLE 1

A layer of tantalum was sputter coated on an aluminum foil (37 μm) polyester laminate (25 μm). A mask consisting of a silk screen with an array of VOID messages, 1 cm in size and spaced 1 cm apart, was prepared by techniques well known in graphic arts. The screen formed a negative image with the VOID areas open and the surrounding area blocked off. The screen was then pressed onto a coupon of the Ta coated foil and a UV curable type screen printable plating and etch resist ink, Macumage 19408 ) Manufactured by MacDermid Inc.), was applied through the open areas leaving an array of VOID messages as positive images.

Immediately the foil was anodized at room temperature in a 0.25 M citric acid solution doped with hydrofluoric acid (65 ppm). Anodization was carried out at a constant voltage of 120 V for 30 seconds over which time the starting current of 7A decayed. This produced a deep blue colour.

The foil was then removed from the anoidizing bath and the inked patterns, which had acted as a resist to the fluoride only, were stripped by rinsing in water. The foil was uniformly coloured deep blue with no evidence of the hidden messages.

Next the foil was run through a bench-type laminator, Doculam Standard Roll Laminator, and a transparent pressure sensitive overlayer film was applied on top and a transfer adhesive with a release liner backing was applied on the bottom. The overlayer was a 12 μm thick film with a medium strength adhesive, Fasson 0.5 mil SuperCold Seal Over-laminating Film, while the underlayer was Fastpae 1151 from Avery Co.

The release liner was removed and the foil sample was manually laminated with a roller onto a sheet of painted aluminum. When lifted the colour disappeared on the unmasked areas resulting in an array of deep blue VOID messages against a grey, metallic background.

EXAMPLE 2

A coil of tantalum (5 cm by 60 m) coated aluminum foil/polyester, similar in construction to Example 1, was used here. Application of the ink resist and anoidization were carried out on a continuous laboratory pilot anodizing cell. The resist ink, masking pattern and silk screening apparatus were the same as described in Example 1.

The laboratory silk screening unit was mounted on line in the anodizing unit between the payoff and the anodizing section. The foil was continuously run through the line at a speed of 4 fpm. It was anoidized in a 0.25 M citric acid electrolyte, at room temperature, doped with HF (75 ppm) directly after the resist was manually applied with the screening unit. An anodizing voltage of 150 V with a current of 4A and a dwell time of 40 seconds produced a deep blue colour. Strips of the material were removed from the line and the ink was stripped by rinsing with water. The foil displayed with blue colour with little evidence of hidden messages.

The overlayer and underlayer materials were applied as in Example 1. After removal of the release liner, the sample was manually laminated with a roller to a sheet of painted aluminum. When lifted the sample displayed an array of blue VOID messages and also had a loss of colour in the unmasked areas.

EXAMPLE 3

An array of VOID messages as described in Example 1 was silk screened onto a coupon of Ta coated aluminum foil/polyester laminate, similar to that in Example 1. The resist ink used was Advance Co.'s Alka-Strip R-569which is an air dry silk screen printable etch resist. Directly after screening the foil sample was anodized at room temperature in a 0.25 M citric acid electrolyte doped with HF (70 ppm). Anodization was carried out for 30 seconds at 105 V.

The foil was removed from the anodizing bath and the ink was stripped by rinsing with water. The sample was removed from the bath and the ink was stripped by rinsing with water. The sample had a uniform wine/red colour with no evidence of hidden messages.

The overlayer and underlayer materials were the same as in Example 1 and were applied similarly with the Doculam Laminator. After removal of the release liner, the foil was manually laminated with a roller onto a sheet of painted aluminum. When lifted the sample displayed an array of wine/red coloured VOID messages and also had a loss of colour in the unmasked areas.

EXAMPLE 4

A coupon of Ta coated Al foil/polyester laminate (20 μm foil/25 μm polyester) was manually rubber stamped with the message PERSONAL & CONFIDENTIAL using a flexographic printing ink. The ink, A48889, a flexographic printing ink product of BASF Ink Co., was reduced 30% with butyl cellosolve solvent.

Directly after message application the sample was anodized at room temperature in a 0.25 M citric acid electrolyte doped with HF (50 ppm). Anodization was carried out for 20 seconds at 125 V.

The foil was removed from the anodizing bath and the ink was stripped by rinsing with water. It had a uniform deep blue colour with no evidence of the hidden message.

A 5 mil thick polyester film overlayer, having a heat sensitive adhesive, was laminated onto the foil with the same Doculam Laminator, as in Example 1, set to an operating temperature of 150° C.

The overlayer could be peeled manually. The colour disappeared on the unmasked areas leaving a blue message of PERSONAL & CONFIDENTIAL. Pressing the plastic overlayer back onto the foil did not restore the colour.

EXAMPLE 5

A coupon of Ta coated Al foil/polyester laminate (20 μm/25 μm polyeter) was manually rubber stamped with the message PERSONAL & CONFIDENTIAL using an ink jet printing ink. The ink, 16-8200Q, an ink jet printing ink, was a product of Video Jet Systems.

Immediately after message stamping the foil was anodized at room temperature in a 0.25 M citric acid electrolyte doped with HF (50 ppm). Anodization was carried out for 30 seconds at 140 V.

The sample was removed from the bath and the ink was stripped by immersion in 4% NaOH at room temperature for 5 seconds followed by a water rinse. The sample had a uniform light green colour with no evidence of a hidden message.

A 5 mil thick polyester overlayer film, having a heat sensitive adhesive, was laminated with the Doculam Laminator, as in Example 1, set at an operating temperature of 150° C.

The overlayer could be peeled manually. The colour disappeared on the unmasked areas leaving a light green message of PERSONAL & CONFIDENTIAL. Pressing the plastic back onto the foil did not restore the colour.

EXAMPLE 6

Peelable colour change devices were produced by coating limited areas of a layer of niobium supported on aluminum foil with R-569screening ink from Advance Co. in the form of a message ("VOID"). The coated samples were anodized for 20 seconds in an electrolyte containing 200 ppm of fluoride at two voltages. The anodized samples were washed and a 5 mil heat seal overlayer was applied. The results were as follows:

20 v blue - message visible after peeling

120 V pink - message visible after peeling.

The masking material clearly blocked the effect of the fluoride in the coated areas.

EXAMPLE 7

Messages were screened on Ta samples using Vaseline as the masking material and anodization was carried out for 20 seconds at voltages of 110, 125 and 150 V in electrolytes containing 60 ppm of fluoride. After anodizing, a 5 mil heat seal overlayer was applied.

After removal of the overlayer the message remained, indicating that Vaseline works as a resist in the process.

EXAMPLE 8

Peelable samples were made by applying drops of calibration grade n-heptadecane (a very pure substance of low conductivity) on Ta. Anodization was carried out for 20 seconds at 125 V in an electrolyte containing 60 ppm of fluoride. After peeling, the areas corresponding to the drops of the n-heptadecane were left intact (no colour change) indicating that the material blocked the fluoride.

What we claim is:

1. In a process for producing colour change devices incorporating latent indicia by anodizing a colour-generating metal, having limited surface areas thereof covered by a mask, in the presence of a fluoride as an adhesion-reducing agent in order to produce a colour-generating laminate incorporating an anodic film having detachable and non-detachable areas, and adhering a transparent or translucent sheet onto said anoidic oxide film to facilitate detachment of parts of said film from said colour generating metal, the improvement which comprises forming said mask from a masking material which permits anodization of areas of said surface covered by said mask while preventing said adhesion-reducing agent from exerting a substantial adhesion-reducing effect in said areas of said surface covered by said mask, and forming an anodic film having detachable and nondetachable areas by means of a single anodization step carried out in the presence of said adhesion-reducing agent.

2. A process according to claim 1, wherein said masking material comprises a non-aqueous solution of an organic polymer.

3. A process according to claim 1, wherein said masking material comprises an uncured non-aqueous solvent based resist.

4. A process according to claim 1, wherein said masking material comprises a non-aqueous printing ink.

5. A process according to claim 1, wherein said masking material comprises an organic polymer selected from the group consisting of polystyrene, polyamide, nitrocellulose, epoxy resin, alkyd resin and epoxy acrylate.

6. A process according to claim 5, wherein said mask further comprises a non-aqueous solvent selected from the group consisting of methanol, methyl ethyl ketone and mixtures thereof.

7. A process according to claim 1 wherein said masking material comprises an ink or uncured resist selected from the group consisting of an ultraviolet curable screen printing etch resist containing an epoxy acrylate polymer, a screen printing etch resist containing an alkyd resin and glycol ether solvent, a modified nitrocellulose-based flexographic ink, a polyamide-based flexographic ink, a petroleum jelly, an epoxy-based screen printing ink, and an ink jet printing ink containing polystyrene and including methanol and methyl ethyl ketone solvent systems.

8. A process according to claim 1, wherein said masking material is applied to said part of the surface of said metal to a thickness in the range of 1 $\mu$m to 100 $\mu$m.

9. A process according to claim 1, wherein said masking material is applied to said part of the surface of the metal by a method selected from the group consisting of silk-screening, stamping, spraying through a mask, painting, brushing, screen painting, flexographic printing and rubbing on.

10. A process according to claim 1, wherein said fluoride is HF.

11. A process according to claim 1, wherein said colour generating metal is selected from the group consisting of valve metals, refractory metals, semi-metals and semiconductors.

12. A process according to claim 1, wherein said colour generating metal is selected from the group consisting of Ta, Nb, Zr, Hf, Ti, W, V, Mo, Ni, Fe, Cr, Bi and Si.

13. A process according to claim 1, wherein said colour generating metal comprises Ta.

14. A process according to claim 1 wherein said colour generating metal comprises Nb.

15. A process according to claim 1, wherein said colour generating metal is in the form of a thin film supported on a substrate.

16. A process according to claim 15, wherein said substrate is thin and flexible.

* * * * *